US005113678A

United States Patent [19]

Mannaka et al.

[11] Patent Number: 5,113,678

[45] Date of Patent: May 19, 1992

[54] METHOD FOR CONTROLLING PLATE MATERIAL HOT ROLLING EQUIPMENT

[75] Inventors: Toshio Mannaka, Katsuta; Tomoaki Kimura; Mitsuru Koyama, both of Hitachi, all of Japan

[73] Assignee: Hitachi, Ltd., Tokyo, Japan

[21] Appl. No.: 675,959

[22] Filed: Mar. 27, 1991

Related U.S. Application Data

[63] Continuation of Ser. No. 254,586, Oct. 7, 1988.

[30] Foreign Application Priority Data

Oct. 9, 1987 [JP] Japan ..... 62-253697

[51] Int. Cl.[5] ..... B21B 1/46; B21B 37/06; B22D 11/16

[52] U.S. Cl. ..... 72/8; 72/205; 72/235; 29/527.7; 164/413; 164/476; 364/472

[58] Field of Search ..... 72/8, 10, 17, 19, 21, 72/199, 205, 234, 235, 7; 164/80, 154, 413, 428, 436, 449, 476, 480; 29/527.7; 364/472

[56] References Cited

U.S. PATENT DOCUMENTS

| | | | |
|---|---|---|---|
| 3,358,358 | 12/1967 | Jenks et al. | 72/205 |
| 3,367,162 | 2/1968 | Kazebee et al. | 72/205 |
| 3,478,808 | 11/1969 | Adams | 364/472 |
| 3,798,940 | 3/1974 | Frostick | 72/8 |
| 3,861,456 | 1/1975 | Gallucci et al. | 164/413 |
| 4,087,859 | 5/1978 | Anbe | 72/8 |
| 4,089,196 | 5/1978 | Kondo et al. | 72/21 |
| 4,408,470 | 10/1983 | Fromont et al. | 72/19 |
| 4,532,789 | 8/1985 | Bruinsma et al. | 72/205 |

FOREIGN PATENT DOCUMENTS

| | | | |
|---|---|---|---|
| 1452117 | 2/1973 | Fed. Rep. of Germany . | |
| 2834102 | 2/1980 | Fed. Rep. of Germany . | |
| 3434284 | 5/1985 | Fed. Rep. of Germany . | |
| 0006701 | 1/1981 | Japan | 72/235 |
| 0033017 | 2/1984 | Japan | 72/8 |
| 0061514 | 4/1984 | Japan | 72/205 |
| 0150609 | 8/1984 | Japan | 72/199 |
| 0186106 | 8/1986 | Japan . | |

*Primary Examiner*—Lowell A. Larson
*Assistant Examiner*—Thomas C. Schoeffler
*Attorney, Agent, or Firm*—Antonelli, Terry Stout & Kraus

[57] ABSTRACT

A plate-like rolled material fed from a continuous casting equipment is rolled by a vertical mill for width control. A pair of horizontal mills are disposed one on each of the entry side and the delivery side of the vertical mill. Both the horizontal mills are controlled in their speeds to impart a predetermined tensile force to the rolled material without effecting thickness control of the rolled material. The roll speed of the horizontal mill disposed on the delivery side is controlled to be higher than that of the horizontal mill disposed on the entry side. This enables preventing of failure in the shape of the rolled material.

23 Claims, 4 Drawing Sheets

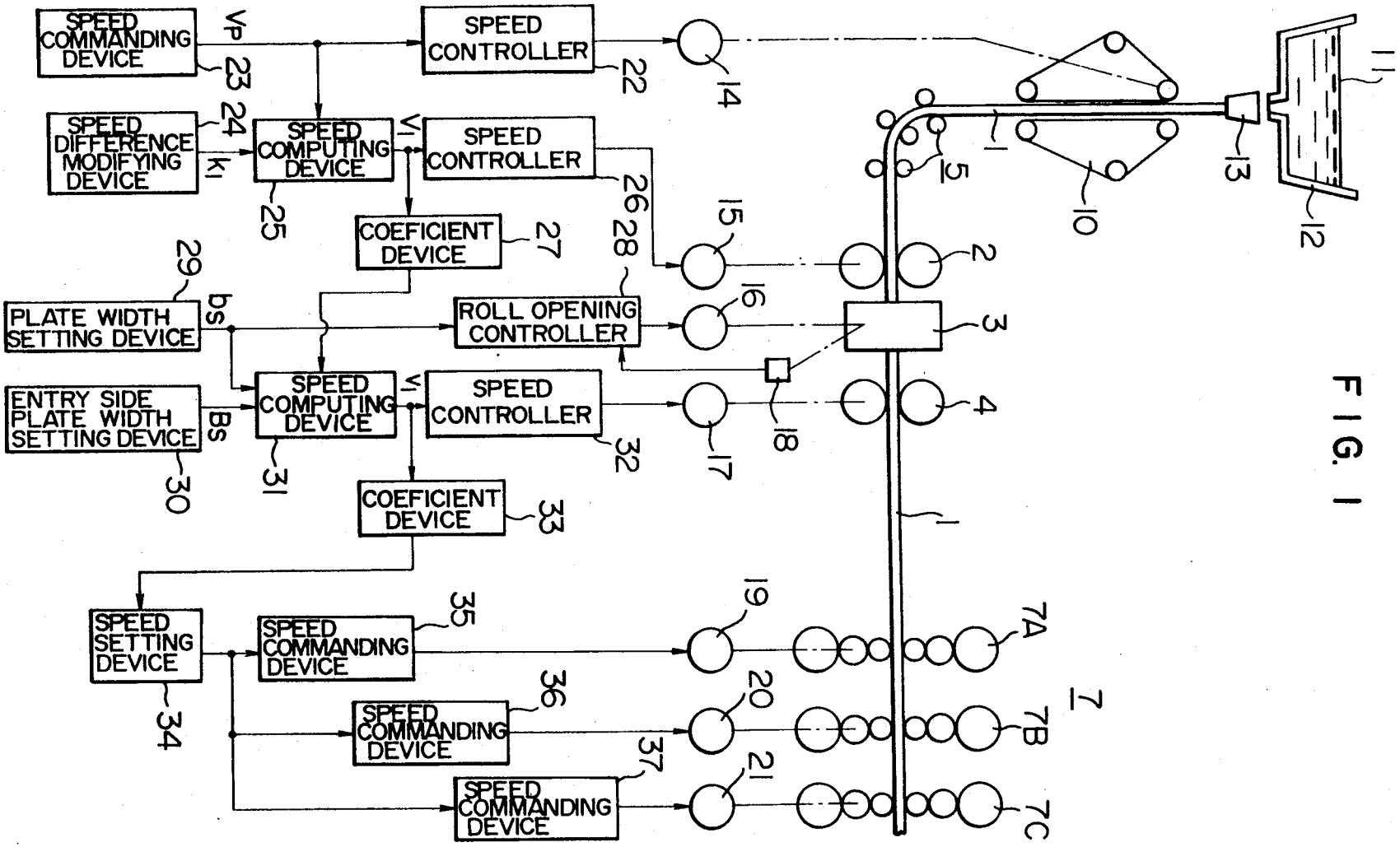
FIG. 1
SPEED COMMANDING DEVICE
SPEED CONTROLLER
SPEED DIFFERENCE MODIFYING DEVICE
SPEED COMPUTING DEVICE
SPEED CONTROLLER
COEFICIENT DEVICE
ROLL OPENING CONTROLLER
PLATE WIDTH SETTING DEVICE
SPEED COMPUTING DEVICE
SPEED CONTROLLER
ENTRY SIDE PLATE WIDTH SETTING DEVICE
COEFICIENT DEVICE
SPEED SETTING DEVICE
SPEED COMMANDING DEVICE
SPEED COMMANDING DEVICE
SPEED COMMANDING DEVICE
Vp
k1
V1
V1
bs
Bs

METHOD FOR CONTROLLING PLATE MATERIAL HOT ROLLING EQUIPMENT

This is a continuation of application Ser. No. 07/254,586, filed Oct. 7, 1988.

BACKGROUND OF THE DISCLOSURE

The present invention relates to a control device method for plate material hot rolling equipments for width control with which a plate material (rolled material) fed from a continuous casting equipment is rolled into a desired plate width.

In these days, with technical advance of continuous casting equipments, it has been developed to practice continuous rolling by successively supplying a plate material fed from the continuous casting equipment to a finish mill. Such continuous rolling makes it possible to achieve reduction of labor and enhance the manufacturing efficiency of plate materials.

Meanwhile, there has been endeavored to increase the capacity of an ingot melting container, called a tundish, in continuous casting equipments. An increase in the capacity of the ingot melting container requires to change a width of plate material during continuous rolling. Some types of continuous casting equipments can accommodate such a change in plate width to some extent. However, most of well-known continuous casting equipments have a difficulty in rapidly, high-accurately and easily adapting to the various demands of change in plate width.

To overcome the foregoing difficulty, it has been proposed to dispose a vertical mill on the delivery side of a continuous casting equipment and then roll a plate material to any desired width. The plate width can easily be changed by varying a roll spacing of the vertical mill. This type arrangement is disclosed in Japanese Patent Laid-Open No. 60-186106 (1986), for example. Note that in Japanese Patent Laid-Open No. 61-186106 (1986), a plurality of vertical mills are disposed to prevent the plate material from buckling. Further, in Japanese Patent Laid-Open No. 61-186106 (1986), a horizontal mill is disposed on the delivery side of the vertical mill to make up each stand group comprising a vertical mill and a horizontal mill in pair. Though not explicitly stated, it is believed that the horizontal mill has a function to roll the plate material into a desired thickness.

When rolling of a plate material into a desired width is carried out by a vertical mill on the delivery side of a continuous casting equipment, the plate material requires to be preloaded with a tensile force from the viewpoint of preventing it from buckling. On the other hand, since no rolling process is included between the continuous casting equipment and the vertical mill, a fragile structure, called dendrite, composed of principally impurities is formed on the surface portion of the rolled material. Therefore, in case of rolling the plate material to a desired width by the vertical mill, it is desired to impart a minute tensile force at a necessary minimum level to the rolled material.

SUMMARY OF THE INVENTION

It is an object of the present invention to provide a control device method for plate material hot rolling equipments with which a plate material of high quality can be produced without causing a failure in the shape of the plate material fed from a continuous casting equipment.

Another object of the present invention is to provide a control device method for plate material hot rolling equipments with which the tensile force can be prevented from varying even in case of changing a set value of plate width during rolling of the rolled material, without causing a failure in the shape of the plate material.

One feature of the present invention resides in disposing a pair of horizontal mills one on each of the entry side and the delivery side of a vertical mill for rolling a rolled material fed from a continuous casting equipment into a desired plate width, both of the horizontal mills being controlled in respective speeds to impart a predetermined tensile force to the rolled material.

Another feature of the present invention resides in enabling to set a target value of plate width for the vertical mill, and allowing the horizontal mill on the delivery side to be controlled in its speed so that, even in case of changing a set value of plate width, a tensile force of the rolled material can be controlled to any set value.

BRIEF DESCRIPTION OF THE DRAWINGS

FIG. 1 is a block diagram showing one embodiment of the present invention.

DETAILED DESCRIPTION OF PREFERRED EMBODIMENTS

Figure 2:
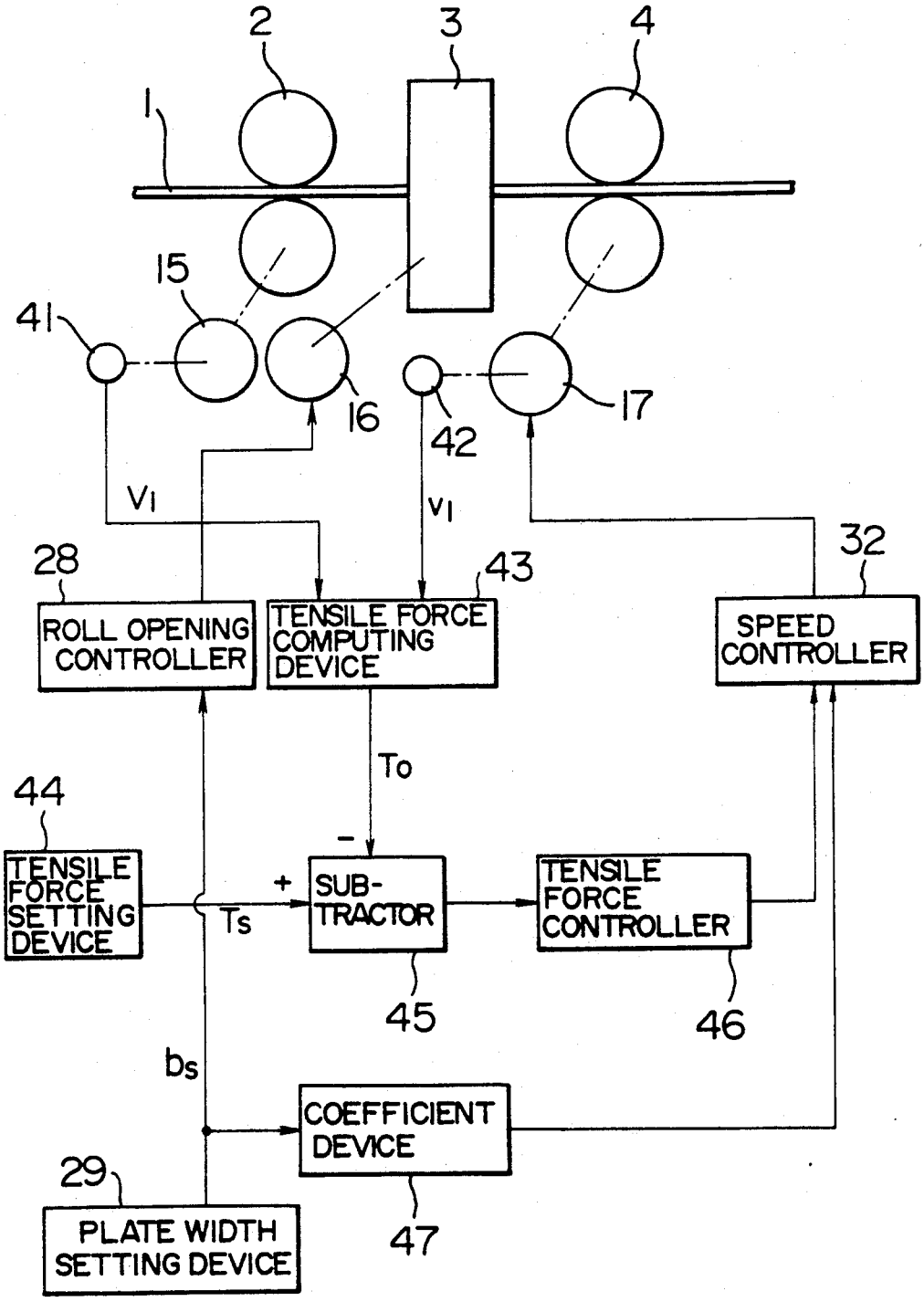
FIG. 2 through 4 are block diagrams showing respective essential parts of other embodiments of the present invention.

FIG. 1 shows one embodiment of the present invention. In FIG. 1, molten ingot 11 is introduced from a tundish 12 to a continuous casting machine (hereinafter simply referred to as a machine) 10 through a plug 13. The continuous casting machine 10 solidifies the molten ingot 11 to form a plate material 1. Continuous casting machines are mainly grouped into fixed type mold casters, caterpillar type casters and belt type casters. The belt type casters are subdivided into single belt horizontal casters, twin belt horizontal casters (Hazellet twin belt casters), and twin belt vertical casters. In this embodiment, a twin belt vertical caster is illustrated. The machine 10 is driven by a motor 14 at a constant speed. The plate material 1 formed by the machine 10 is fed through a group of guide rolls 5 to a pair of horizontal mills 2, 4 and an intermediate vertical mill 3 for rolling the plate material for the width control. The horizontal mills 2, 4 are driven by motors 15, 17, respectively. A drive motor 16 directly mechanically coupled to the vertical mill 3 is to regulate the degree of roll opening, and a drive motor for rotatively driving rolls of the vertical mill 3 is not shown. Having been rolled by the vertical mill 3 into a desired width, the plate material 1 is fed to a finish mill 7 comprising three stand groups 7A, 7B, 7C. These finish mills 7A, 7B, 7C are driven by motors 19, 20, 21, respectively.

In response to a speed command signal $V_p$ applied from a speed commanding device 23, a speed controller 22 controls the motor 14 for driving the machine 10. The speed command signal $V_p$ is determined based on a solidifying speed of the molten ingot 11 in the machine 10, and normally held at a constant level. A speed computing device 25 outputs a speed command signal $V_1$ of the drive motor 15 for the horizontal mill 2 based on both the speed command signal $V_p$ and a modification coefficient $k_1$ given from a speed difference modifying device 24. In response to a speed command signal $V_1$, a speed controller 26 controls the motor 15 for driving the horizontal mill 2. In order to make zero a tensile force applied between the machine 1 and a plate width controller composed of the vertical mill 3 and the horizontal mills 2, 4, it is needed to set the correction coefficient $k_1$ to be $k_1=1.0$. To impart a minute tensile force, the modification coefficient $k_1$ requires to be set $k_1=1.1-1.2$. In other words, when the modification coefficient $k_1$ is set to be $k_1=1.0$, the roll speed of the horizontal mill 2 is held at a level corresponding to the speed command signal $V_p$, i.e., equal to a delivery speed of the plate material 1 from the machine 10 (line speed of the plate material 1), so that there occurs no tensile force in this region.

A roll opening controller 28 receives a target value of plate width bs set by a plate width setting device 29, to control the motor 16 for changing the degree of roll opening of the vertical mill 3. The degree of roll opening of the vertical mill 3 is detected by a roll opening detector 18 and fed back to the roll opening controller 28. Thus, the roll opening controller 28 regulates the degree of roll opening when the target value of plate width bs is changed, or when the actual degree of roll opening (actual value of plate width) is not coincident with the target value of plate width bs. In this way, the plate width (degree of roll opening) is set to the vertical mill 3, and the rolls thereof are rotatively driven by a drive motor (not shown) for implementing rolling of the plate material into a desired width.

On the other hand, the roll speed of the horizontal mill 4 is controlled as follows. The roll speed $V_1$ of the horizontal mill 2 determined by the speed computing device 25 is input to another speed computing device 31 through a coefficient device 27. Applied to the speed computing device 31 are also the target value of plate width bs from the plate width setting device 29 and an entry side set value of plate width Bs from an entry side plate width setting device 30. The set value of plate width Bs is a fixed value determined by the machine 10. The horizontal mills 2, 4 disposed on the entry side and the delivery side of the vertical mill 3, respectively, serve to impart a tensile force to the plate material during rolling thereof to a desired width, and d not modify its contact pressure. Assuming that the speed, plate thickness and plate width on the entry side of the vertical mill 3 are given by V, H and B, respectively, and the speed, plate thickness and plate width on the delivery side thereof are given by v, h and b, respectively, the following equation is established on the basis of the mass flow conservation law associated with the entry and delivery sides of the vertical mill 3:

$$B \cdot H \cdot V = b \cdot h \cdot v \quad (1)$$

Since the horizontal mills 2, 4 do not perform thickness regulation, H=h is established and therefore the speed v on the delivery side of the vertical mill 3 is obtained as follows from the equation (1):

$$v = B \cdot V / b \quad (2)$$

The speed command signal $V_1$ output from the speed computing device 25 corresponds to the entry side speed V in the equation (2), the plate width target value bs corresponds to the delivery side plate width b, and the entry side plate width set value Bs corresponds to the entry side plate width B, respectively. The speed computing device 31 determines the delivery side speed v based on the equation (2). At this time, in the present invention, the speed command signal $V_1$ is multiplied by a coefficient $k_2$ (where $k_2>1$) in the coefficient device 27 and the resulting product is then applied to the speed computing device 31. Therefore, the speed command signal $v_1$ output from the speed computing device 31 becomes larger than the delivery side speed v directly determined from the equation (2) by an amount corresponding to the coefficient $k_2$. The coefficient k is selected to such a value that a minute tensile force of 0.2–0.5 kg/mm$^2$ is imparted to the plate material 1 rolled for width control by the vertical mill 3 into a desired width. A speed controller 32 controls the motor 17 in response to the speed command signal $v_1$, so that the rolls of the horizontal mill 4 are driven at a speed $v_1$. The roll speed $v_1$ of the horizontal mill 4 is slightly higher than the roll speed $V_1$ of the horizontal mill 2 corresponding to the coefficient $k_2$. As a result, the plate material 1 rolled by the vertical mill 3 is subjected to a minute tensile force. By imparting a minute tensile force to the rolled material 1 in this way, plate width control can be effected without causing buckling and failure in shape of the rolled material 1. Further, because the speed computing device 31 constantly performs computation of the equation (2) and outputs the speed command signal $v_1$, the tensile force can positively be prevented from varying even when the target value of plate width is changed by the plate width setting device 29 during rolling of the plate material into a desired width.

It will easily be appreciated that while the target value of plate width bs is input to the speed computing device 31 in the embodiment of FIG. 1, the roll opening signal (actual value of plate width) from the roll opening detector 18 may instead be applied to the speed computing device 31.

Having been thus rolled by the plate width controller into a desired width, the plate material 1 is sent to the finish mill 7 comprising three stand groups where it is rolled into a desired thickness. The respective stand groups 7A, 7B, 7C of the finish mill 7 performs successive speed control as follows.

A speed setting device 34 is to set a line speed of the finish mill 7, and receives a speed signal $k_3v_1$ from a coefficient device 33 (where $k_3$ is a coefficient from the coefficient device 33) for modifying a set value of line speed. Speed commanding devices 35, 36, 37 receive set values of line speed and output speed command signals for the respective stand groups. The speed command signals from the speed commanding devices 35, 36, 37 are set such that their values become larger gradually toward the downstream side. By so doing, a predetermined tensile force is imparted to the rolled material 1.

As described above, the plate material 1 is rolled into a desired width by disposing the horizontal mills one on each of the entry side and the delivery side of the vertical mill 3, and controlling the roll speeds of both the horizontal mills to impart a predetermined tensile force to the rolled material 1. Therefore, plate width control of the rolled material 1 can satisfactorily be performed without causing buckling. The roll speed of the horizontal mill on the delivery side is determined taking into account the plate width of the rolled material 1 (target or actual value of plate width), the tensile force can positively be prevented from varying even when the target value of plate width is modified during rolling.

FIG. 2 shows an essential part of another embodiment of the present invention. In FIG. 2, the tensile force is computed from the difference in speeds of both the horizontal mills so as to impart a predetermined minute tensile force.

In FIG. 2, the same reference numerals as those in FIG. 1 indicates the corresponding parts. Pulse generators 41, 42 for generating pulses used for speed detection are mechanically coupled to the drive motors 15, 17 of the horizontal mills 2, 4, respectively. The speed pulses generated from the pulse generators 41, 42 are input to a tensile force computing device 43. The tensile force computing device 43 determines an actual value of tensile force To from the following equation:

$$To = \int (v_1 - V_1)dt \quad (3)$$

The tensile computing device 43 performs computation of the equation (3) per 100 ms, for example, to determine the actual value of tensile force To. Where the tensile force computing device 43 has a function capable of digital computation, the actual value of tensile force To can be determined from the difference in number of both speed pulses per unit time (e.g., 100 ms). A set value of tensile force Ts set by a tensile force setting device 44 is compared with the actual value of tensile force To in a subtractor 45 with respective polarities as shown, and the resulting difference is input to a tensile force controller. The tensile force controller 46 performs compensating computation to output speed command signal $v_1$ and applies it to the speed controller 32, so that the differential tensile force becomes zero. The tensile force controller 46 increases the speed command signal $v_1$, if the differential tensile force is positive. On the other hand, a coefficient device 47 receives the target value of plate width bs set by the plate width setting device 29, and determines a coefficient of velocity ($\partial v/\partial b$) that indicates a speed correction amount associated with a change in the target value of plate width. The coefficient of velocity is normally determined from actual measurement carried out during trial operation. As the coefficient of velocity becomes larger, the speed correction amount is increased to raise the roll speed of the horizontal mill 4. The speed controller 32 adds the speed command signal $v_1$ applied from the tensile force controller 46 and the speed correction amount from the coefficient device 47, and control the motor 17 based on the resulting sum for regulating the roll speed of the horizontal mill 4. As a result, the tensile force imparted to the plate material 1 between the horizontal mills 2 and 4 is controlled to the set value Ts set by the tensile force setting device 44.

As described above, the embodiment shown in FIG. 2 can also impart a predetermined minute tensile force to the rolled material during rolling thereof into a desired width. Even when the target value of plate width is modified while rolling, the tensile force of the plate material 1 can constantly be regulated to the set value Ts, thereby surely preventing variations in the tensile force.

Figure 3:
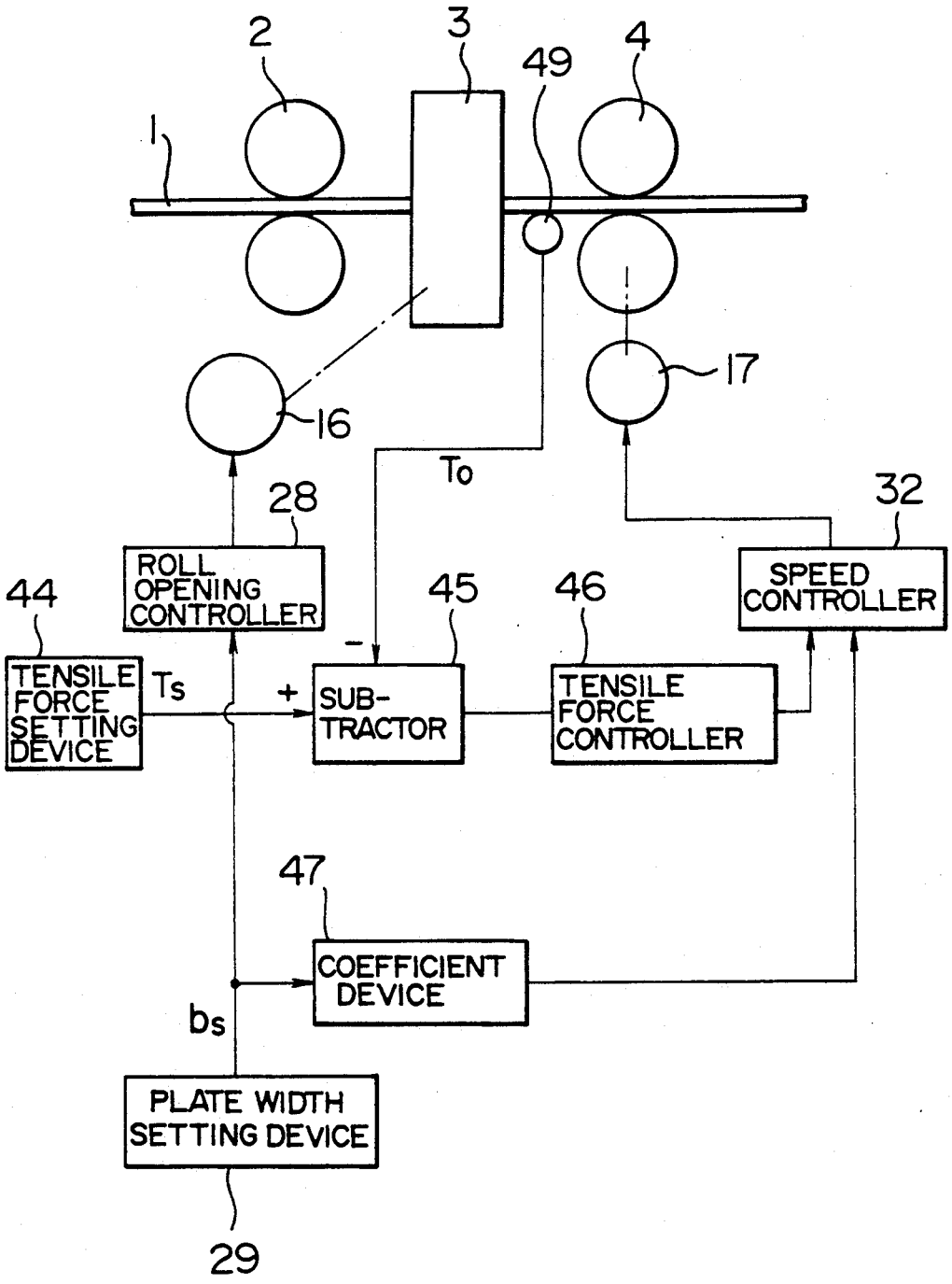

FIG. 3 shows still another embodiment of the present invention.

In the embodiment shown in FIG. 3, the tensile force of the plate material 1 is detected by a tensile force detector 49 and then compared with the set value of tensile force Ts set by the tensile force setting device 44. The remaining parts are identical to those shown in FIG. 2.

The embodiment shown in FIG. 3 can also impart a minute tensile force to the plate material 1, and prevent the tensile force from varying even when the target value of plate width bs is changed.

Figure 4:
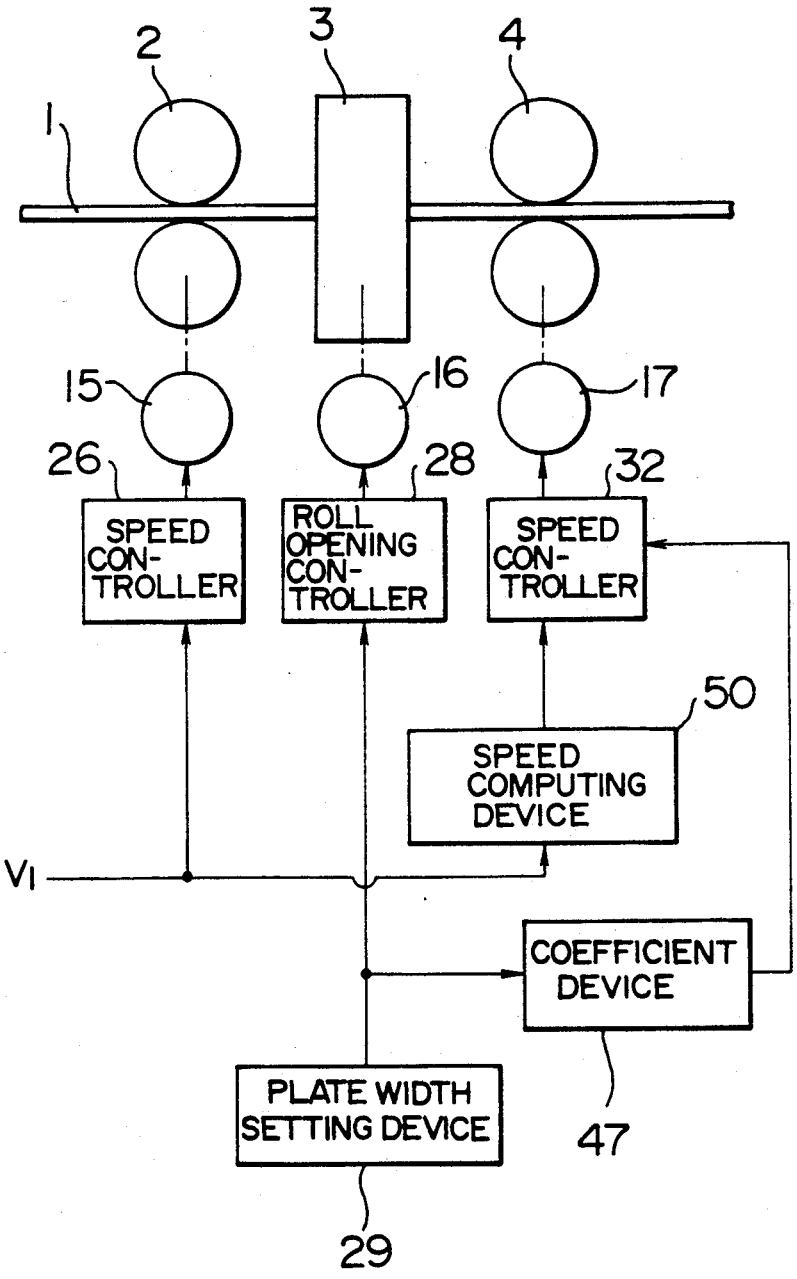

FIG. 4 shows still another embodiment of the present invention.

In the embodiment shown in FIG. 4, the roll speed $V_1$ of the horizontal mill 2 on the entry side is detected to compute the roll speed $v_1$ of the horizontal mill 4 on the delivery side.

The minute tensile force required to be imparted to the plate material 1 between the horizontal mills 2 and 4 is determined by the quality of the plate material 1. Accordingly, the roll speed $v_1$ of the horizontal mill 4 necessary for imparting a predetermined tensile force can be determined from the following equation based on the equation (3):

$$v_1 = V_1 + (dT/dt) \quad (4)$$

(dT/dt) in the equation (4) represents a change rate of the set tensile force for a minute period of time. A speed computing device 50 receives the speed command signal $V_1$ of the horizontal mill 2, and performs computation of the equation (4) for determining a speed command signal $v_1$ which is then applied to the speed controller 32. Similarly to the embodiment of FIG. 2, the speed correction signal from the coefficient device 47 is also applied to the speed controller 32. The speed controller 32 adds the speed control signal $v_1$ and the speed correction signal, and controls the roll speed of the horizontal mill 4 based on the resulting sum. The roll speed of the horizontal mill 4 is controlled to meet the equation (4), so that the set value of tensile force Ts preset as desired can be imparted to the plate material 1.

Thus, the embodiment shown in FIG. 4 can also impart a minute tensile force to the plate material 1, and prevent the tensile force from varying at the time of changing the target value of plate.

As described above, according to the present invention, a predetermined tensile force is imparted to the rolled material by controlling the roll speeds of both the horizontal mills disposed one on each of the entry side and the delivery side of the vertical mill. Therefore, rolling of the plate material into a desired width can satisfactorily be effected without causing any failure in shape of the rolled material. Further, even when the target value of plate width is changed during rolling of the plate material for width control, the tensile force can positively be prevented from varying.

Although the foregoing embodiments have been described as employing a single vertical mill, it is a matter of course that in case of rolling the plate material into a desired width using a plurality of vertical mills, similar plate width control can also be effected by disposing a pair of horizontal mills one on each of the entry side and the delivery side of each vertical mill.

In addition, the present invention is not limited to the case of continuously rolling the rolled material fed from a continuous casting machine for width control, and the similar effect is also obtainable with the case where the rolled material fed from a continuous casting machine is wound up in a thermostatic chamber and rolled by a vertical mill into a desired width after the completion of winding-up, as described in Japanese Patent Laid-Open 61-186106 (1986) cited above as a reference.

What is claimed is:

1. A control device for a plate material hot rolling equipment comprising a vertical mill for rolling a plate-like rolled material fed thereto for width control, pairs of first and second horizontal rolls disposed one pair on each of the entry side and the delivery side of said vertical mill, and speed control means for controlling said pairs of horizontal rolls to produce a difference between roll speeds of said pair of first and second horizontal rolls for imparting a predetermined tensile force to said rolled material between said pairs of horizontal rolls, said pairs of first and second horizontal rolls being controlled to impart the predetermined tensile force to said rolled material controlled in width by said vertical mill without effecting thickness control of said width-controlled rolled material thereby.

2. A control device for a plate material hot rolling equipment comprising a vertical mill for rolling a plate-like rolled material fed thereto for width control, pairs of first and second horizontal rolls disposed one pair on each of the entry side and the delivery side of said vertical mill, first speed control means for controlling a roll speed of said first pair of horizontal rolls disposed on the entry side in response to a first speed command signal given thereto, roll opening control; means for receiving a target value of plate width to control the degree of roll opening of said vertical mill, speed computing means for computing a roll speed of said second pair of horizontal rolls disposed on the delivery side and then outputting the computed result as a second speed command signal for imparting a predetermined tensile force to said rolled material between said pairs of horizontal rolls, speed correcting means for receiving said target value of plate width to output a speed correction amount based on a coefficient of velocity in response to the magnitude of said target value of plate width, and second speed control means for controlling a roll speed of said second pair of horizontal rolls based on said second speed command signal and said speed correction amount, said pairs of first and second horizontal rolls being controlled to impart the predetermined tensile force to said rolled material controlled in width by said vertical mill without effecting thickness control of said width-controlled rolled material thereby.

3. A control device for a plate material hot rolling equipment comprising a vertical mill for rolling a plate-like rolled material fed thereto for width control, pairs of first and second horizontal rolls disposed one pair on each of the entry side and the delivery side of said vertical mill, first speed control means for controlling a roll speed of said first pair of horizontal rolls disposed on the entry side in response to a first speed command signal given thereto, roll opening control means for receiving a target value of plate width to control the degree of roll opening of said vertical mill, speed computing means for receiving the roll speed of said first pair of horizontal rolls, said target value of plate width and an actual value of plate width of said rolled material on the entry side of said vertical mill, and then computing a roll speed of said second pair of horizontal rolls disposed on the delivery side to output the computed result as a second speed command signal for imparting a predetermined tensile force to said rolled material between said pairs of horizontal rolls, and second speed control means for controlling a roll speed of said second pair of horizontal rolls based on said second speed command signal, said pairs of first and second horizontal rolls being controlled to impart the predetermined tensile force to said rolled material controlled in width by said vertical mill without effecting thickness control of said width-controlled rolled material thereby.

4. A control device for a plate material hot rolling equipment comprising a rolled material delivery means for delivering a rolled material having a predetermined width and thickness, a vertical mill for rolling said rolled material for width control, pairs of first and second horizontal rolls disposed one pair on each of the entry side and the delivery side of said vertical mill, first speed control means for controlling a roll speed of said first pair of horizontal rolls disposed on the entry side in response to a first speed command signal, speed computing means for computing a roll speed of said second pair of horizontal rolls disposed on the delivery side and then outputting the computed result as a second speed command signal for imparting a predetermined tensile force to said rolled material between said pairs of horizontal rolls, and second speed control means for controlling a roll speed of said first pair of horizontal rolls in response to said second speed command signal, said pairs of first and second horizontal rolls being controlled to impart the predetermined tensile force to said rolled material controlled in width by said vertical mill without effecting thickness control of said width-controlled rolled material thereby.

5. A control device for a plate material hot rolling equipment according to claim 4, wherein said rolled material delivery means comprises a continuous casting equipment for shaping molten ingot stored in a tundish into a plate material.

6. A control device for a plate material hot rolling equipment comprising a vertical mill for rolling a plate-like rolled material fed thereto for width control, pairs of first and second horizontal rolls disposed one pair on each of the entry side and the delivery side of said vertical mill, first speed control means for controlling a roll speed of said first pair of horizontal rolls disposed on the entry side in response to a first speed command signal given thereto, roll opening control means for receiving a target value of plate width to control the degree of roll opening of said vertical mill, tensile force detecting means for detecting a tensile force of said rolled material between said pairs of horizontal rolls, and then computing a roll speed of said second pair of rolls disposed on the delivery side based on the difference between the set value of tensile force and the actual value of tensile force detected by said tensile force detecting means, to output the computed result as a second speed command signal for imparting a predetermined tensile force to said rolled material between said pairs of horizontal rolls, speed correcting means for receiving said target value of plate width to output a speed correction amount based on a coefficient of velocity in response to the magnitude of said target value of plate width, and second speed control means for controlling a roll speed of said second pair of horizontal rolls based on said second speed command signal and said speed correction amount, said pairs of first and second horizontal rolls being controlled to impart the predetermined tensile force to said rolled material controlled in width by said vertical mill without effecting thickness control of said width-controlled rolled material thereby.

7. A control device for a plate material hot rolling equipment according to claim 6, wherein said tensile force detecting means computes the tensile force of said roller material based on the roll speeds of both said horizontal mills.

8. A method for controlling plate material hot rolling equipment having a vertical mill for rolling a plate-like rolled material fed thereto for width control, pairs of first and second horizontal rolls being disposed one pair on each of the entry side and the delivery side of the vertical mill, comprising the steps of:

controlling a roll speed of the first pair of horizontal rolls disposed on the entry side in response to a first speed command signal;

calculating a roll speed of the second pair of horizontal rolls disposed on the delivery side and outputting a calculated result as a second speed command signal for imparting a predetermined tensile force to the rolled material between the pairs of the first and second horizontal rolls;

controlling a roll speed of the pair of the second horizontal rolls in response to the second speed command signal; and controlling the pairs of the first and second horizontal rolls to impart the predetermined tensile force to the rolled material without effecting thickness control of the rolled material by the pairs of the first and second horizontal rolls.

9. A method for controlling plate material hot rolling equipment having a vertical mill for rolling a plate-like rolled material fed thereto for width control, pairs of first and second horizontal rolls being disposed one pair on each of the entry side and the delivery side of the vertical mill, comprising the steps of:

controlling the speed of the pairs of the first and second horizontal rolls to produce a difference between roll speeds of the pairs of the first and second horizontal rolls for imparting a predetermined tensile force to the rolled material between the pairs of the first and second horizontal rolls; and controlling the pairs of the first and second horizontal rolls to impart the predetermined tensile force to the rolled material without effecting thickness control of the rolled material by the pairs of the first and second horizontal rolls.

10. A method according to claim 9, wherein rolled material delivery means are provided for delivering a rolled material having a predetermined width and thickness.

11. A method according to claim 10, wherein the rolled material delivery means includes continuous casting equipment for shaping molten ingot stored in a tundish into a rolled plate material.

12. A method according to claim 9, further comprising the steps of:

controlling a roll speed of the pair of the first horizontal rolls disposed on the entry side in response to a first speed command signal;

calculating a roll speed of the pair of the second horizontal rolls disposed on the delivery side and outputting a calculated result as a second speed command signal for imparting the predetermined tensile force to the rolled material between the pairs of the first and second horizontal rolls; and controlling a roll speed of the pair of the second horizontal rolls in response to the second speed command signal.

13. A method according to claim 12, wherein a roll opening controller receives a target value of a plate width to control the degree of roll opening of the vertical mill in accordance therewith, the step of calculating the roll speed of the pair of the second horizontal rolls including calculating the roll speed in response to the roll speed of the first pair of horizontal rolls, the target value of plate width and an actual value of plate width of the rolled material on the entry side of the vertical mill, computing the roll speed of the pair of the second horizontal rolls, and outputting the computed result as the second speed command signal.

14. A method according to claim 12, further comprising the step of detecting a tensile force of the rolled material between the pairs of the first and second horizontal rolls, the step of computing the roll speed of the pair of the second horizontal rolls includes computing the roll speed based on a difference between a set value of the tensile force and the detected value of tensile force so as to output the computed result as the second speed command signal, generating a speed correction amount based on a coefficient of velocity in response to a magnitude of a target value of plate width of the rolled material, and the step of controlling the roll speed of the pair of the second horizontal rolls includes controlling the roll speed of the second pair of horizontal rolls based on the second speed command signal and the speed correction amount.

15. A method according to claim 14, wherein the step of detecting the tensile force includes computing the tensile force of the rolled material based on the roll speeds of the pairs of the first and second horizontal rolls.

16. A control device for a plate material hot rolling equipment comprising a vertical mill for rolling a plate-like rolled material fed thereto for width control, pairs of first and second horizontal rolls disposed one pair on each of the entry side and the delivery side of said vertical mill, first speed control means for controlling a roll speed of said first pair of horizontal rolls disposed on the entry side in response to a first speed command signal given thereto, speed computing means for computing a roll speed of said second pair of horizontal rolls disposed on the delivery side and then outputting the computed result as a second speed command signal for imparting a predetermined tensile force to said rolled material between said pairs of horizontal rolls, and second speed control means for controlling a roll speed of said second pair of horizontal rolls in response to said second speed command signal, said pairs of first and second horizontal rolls being controlled to impart the predetermined tensile force to said rolled material without effecting thickness control of said rolled material.

17. A control device for a plate material hot rolling equipment comprising a vertical mill for rolling a plate-like rolled material fed thereto for width control, pairs of first and second horizontal rolls disposed one pair on each of the entry side and the delivery side of said vertical mill, first speed control means for controlling a roll speed of said first pair of horizontal rolls disposed on the entry side in response to a first speed command signal given thereto, roll opening control means for receiving a target value of plate width to control the degree of roll opening of said vertical mill, speed computing means for computing a roll speed of said second pair of horizontal rolls disposed on the delivery side and the outputting the computed result as a second speed command signal for imparting a predetermined tensile force to said rolled material between said pairs of horizontal rolls, speed correcting means for receiving said target value of plate width to output a speed correction amount based on a coefficient of velocity in response to the magnitude of said target value of plate width, and second speed control means for controlling a roll speed of said second pair of horizontal rolls based on said second speed command signal and said speed correction amount, said pairs of first and second horizontal rolls being controlled to impart the predetermined tensile force to said rolled material without effecting thickness control of said rolled material.

18. A control device for a plate material hot rolling equipment comprising a vertical mill for rolling a plate-like rolled material fed thereto for width control, pairs of first and second horizontal rolls disposed one pair on each of the entry side and the delivery side of said vertical mill, first speed control means for controlling a roll speed of said first pair of horizontal rolls disposed on the entry side in response to a first speed command signal given thereto, roll opening control means for receiving a target value of plate width to control the degree of roll opening of said vertical mill, speed computing means for receiving the roll speed of said first pair of horizontal rolls, said target value of plate width and an actual value of plate width of said rolled material on the entry side of said vertical mill, and then computing a roll speed of said second pair of horizontal rolls disposed on the delivery side to output the computed result as a second speed command signal for imparting a predetermined tensile force to said rolled material between said pairs of horizontal rolls, and second speed control means for controlling a roll speed of said second pair of horizontal rolls based on said second speed command signal, said pairs of first and second horizontal rolls being controlled to impart the predetermined tensile force to said rolled material without effecting thickness control of said rolled material.

19. A control device for a plate material hot rolling equipment comprising a rolled material delivery means for delivering a rolled material having a predetermined width and thickness, a vertical mill for rolling said rolled material for width control, pairs of first and second horizontal rolls disposed one pair on each of the entry side and the delivery side of said vertical mill, first speed control means for controlling a roll speed of said first pair of horizontal rolls disposed on the entry side in response to a first speed command signal, speed computing means for computing a roll speed of said second pair of horizontal rolls disposed on the delivery side and then outputting the computed result as a second speed command signal for imparting a predetermined tensile force to said rolled material between said pairs of horizontal rolls, and second speed control means for controlling a roll speed of said first pair of horizontal rolls in response to said second speed command signal, said pairs of first and second horizontal rolls being controlled to impart the predetermined tensile force to said rolled material without effecting thickness control of said rolled material.

20. A control device for a plate material hot rolling equipment according to claim 19, wherein said rolled material delivery means comprises a continuous casting equipment for shaping molten ingot stored in a tundish into a plate material.

21. A control device for a plate material hot rolling equipment comprising a vertical mill for rolling a plate-like rolled material fed thereto for width control, pairs of first and second horizontal rolls disposed one pair on each of the entry side and the delivery side of said vertical mill, first speed control means for controlling a roll speed of said first pair of horizontal rolls disposed on the entry side in response to a first speed command signal given thereto, roll opening control means for receiving a target value of plate width to control the degree of roll opening of said vertical mill, tensile force detecting means for detecting a tensile force of said rolled material between said pairs of horizontal rolls, and then computing a roll speed of said second pair of rolls disposed on the delivery side based on the difference between the set value of tensile force and the actual value of tensile force detected by said tensile force detecting means, to output the computed result as a second speed command signal for imparting a predetermined tensile force to said rolled material between said pairs of horizontal rolls, speed correcting means for receiving said target value of plate width to output a speed correction amount based on a coefficient of velocity in response to the magnitude of said target value of plate width, and second speed control means for controlling a roll speed of said second pair of horizontal rolls based on said second speed command signal and said speed correction amount, said pairs of first and second horizontal rolls being controlled to impart the predetermined tensile force to said rolled material without effecting thickness control of said rolled material.

22. A control device for a plate material hot rolling equipment according to claim 21, wherein said tensile force detecting means computes the tensile force of said rolled material based on the roll speeds of both pairs of said horizontal rolls.

23. A control device for a plate material hot rolling equipment comprising a vertical mill for rolling a plate-like rolled material fed thereto for width control, pairs of first and second horizontal rolls disposed one pair on each of the entry side and the delivery side of said vertical mill, and speed control means for controlling said pairs of horizontal rolls to produce a difference between roll speeds of said pairs of first and second horizontal rolls for imparting a predetermined tensile force to said rolled material between said pairs of horizontal rolls, said pairs of first and second horizontal rolls being controlled to impart the predetermined tensile force to said rolled material without effecting thickness control of said rolled material.

* * * * *